US006191735B1

(12) United States Patent
Schineller

(10) Patent No.: US 6,191,735 B1
(45) **Date of Patent: *Feb. 20, 2001**

(54) TIME DELAY APPARATUS USING MONOLITHIC MICROWAVE INTEGRATED CIRCUIT

(75) Inventor: Eugene Ronald Schineller, Park Ridge, NJ (US)

(73) Assignee: ITT Manufacturing Enterprises, Inc., McLean, VA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/900,913

(22) Filed: Jul. 28, 1997

(51) Int. Cl.[7] ..... H01Q 3/22
(52) U.S. Cl. ..... 342/375; 333/164
(58) Field of Search ..... 333/164, 161, 333/156, 139; 342/371, 372, 375

(56) References Cited

U.S. PATENT DOCUMENTS

| | | | | |
|---|---|---|---|---|
| 3,131,367 | * | 4/1964 | Pitts et al. | 333/164 |
| 3,246,265 | * | 4/1966 | Smith-Vaniz | 333/161 |
| 3,276,018 | * | 9/1966 | Butler | 333/156 X |
| 3,295,138 | * | 12/1966 | Nelson | 333/164 X |
| 4,502,027 | * | 2/1985 | Ayasli | 333/161 X |
| 4,649,393 | * | 3/1987 | Rittenbach | 333/164 X |
| 4,931,753 | * | 6/1990 | Nelson et al. | 333/161 |
| 5,136,265 | * | 8/1992 | Pritchett | 333/164 X |
| 5,144,319 | * | 9/1992 | Robert | 333/164 X |
| 5,307,031 | * | 4/1994 | Dick | 333/156 X |

FOREIGN PATENT DOCUMENTS

| | | | | |
|---|---|---|---|---|
| 162001 | * | 6/1989 | (JP) | 333/156 |
| 201603 | * | 9/1991 | (JP) | 333/139 |
| 4032301 | * | 2/1992 | (JP) | 333/164 |

OTHER PUBLICATIONS

DiPaolo, Franco, "A Simple High Yield 6 to 18 GHz GaAs Monlithic Phase Shifter" *Microwave Journal,* Apr. 1997; pp. 92–104;.*

Noste, R.J. et al., "Affordable MMIC Designs for Phased Arrays" *Microwave Journal;* Mar. 1987; pp. 141–147.*

* cited by examiner

*Primary Examiner*—Benny T Lee
(74) *Attorney, Agent, or Firm*—McDermott, Will & Emery

(57) ABSTRACT

A phase shifting microwave circuit is implemented on a gallium-arsenide-based monolithic microwave integrated circuit chip (MMIC) having time-delay means and digital phase shift means and operable in a first mode to time-delay an input RF microwave signal in response to an at least one control signal to cause a corresponding shift in phase of the signal at an output of the circuit, and operable in a second mode to time-delay and phase delay the input RF microwave signal in response to a plurality of control signals to cause a shift in phase of the signal at the output of the circuit corresponding to the sum of the phase shifts caused by each of the individual time-delays and digital phase delay.

11 Claims, 7 Drawing Sheets

TIME DELAY APPARATUS USING MONOLITHIC MICROWAVE INTEGRATED CIRCUIT

FIELD OF THE INVENTION

The invention relates to time delay circuits and more particularly, to an apparatus for producing time delayed microwave signals for large instantaneous bandwidth systems to provide an antenna beam pattern which is substantially constant over the bandwidth of the system.

BACKGROUND OF THE INVENTION

Many modern electrically scanned antenna arrays for radar, communication and electronic countermeasures systems require large instantaneous bandwidth. Historically, electronically scanned antennas have utilized phase shifters in each element of the array to control beam position and direction. However, in moderate to large arrays, such a method results in a beam position which varies with frequency. This prevents instantaneous operation over a large portion of the bandwidth since the beam position will move away from the desired direction, or the beam pattern becomes distorted.

An alternative to phase shifters which can be used to scan the beam in a frequency independent manner is the use of true time delay circuits, whereby the time delay of a signal is varied rather than the phase. While this approach has been recognized, few practical implementations of this method have been developed. One such method involves the use of fiber optic delay lines whereby a microwave signal is carried on a lightwave whose time delay is varied. After the appropriate delay, the lightwave is detected and converted back to a microwave signal.

However, fiber optic delay lines for wideband microwave array antennas have several disadvantages. First, the microwave signal is modulated onto a lightwave at the input to the fiber (delay line) and then converted back (demodulated) to a microwave signal at the fiber output. These processes result in signal loss which can be as high as 20 to 30 dB. This signal loss must be made up by external amplifiers, which add complexity to the system. In addition, the optical detection process adds noise to the microwave signal which cannot be totally removed.

Some of the optical approaches utilize lasers, whose frequency is varied to provide the variable delay. This approach has limitations in the switching time. Whereas the desired switching time for large array communications is fast for example, one microsecond (e.g. 1 $\mu$sec); the achievable time in prior art laser switching devices is relatively slow on the order of 100 msec.

Furthermore, optical approaches tend to be expensive. Since many such devices are required in a typical array (100 to 1000), the cost for producing multiple fiber optic delay lines may be prohibitive.

The approach described here overcomes the shortcomings described above, because all of the time delay is accomplished with microwave circuitry alone, eliminating the need for optical fibers. By eliminating the need to convert from microwaves to light and back again, the large signal loss is eliminated. The approach described here uses microwave switches which are very fast, resulting in switching times of much less than 1 $\mu$sec. Finally, by the use of monolithic microwave integrated circuit (MMIC) technology and printed circuit transmission lines, the approach described here can be implemented at low cost.

SUMMARY OF THE INVENTION

The present invention provides a system for generating time delayed signals from an input microwave RF signal having a wide instantaneous bandwidth. The system comprises a first time-delay circuit having a plurality of conductive paths of varying lengths for the signal to be switchably connected and in response to a first control signal for time-delaying the input microwave signal in a controllable manner to produce a time-delayed microwave signal. A second time-delay circuit comprising a plurality of gallium arsenide-based (GaAs) monolithic microwave integrated circuit (MMIC) chips is coupled to the first time-delay circuit, where each MMIC chip has a plurality of conductive line segments of varying lengths switchably connected and selectable for time-delaying the input time-delayed microwave signal in a controllable manner to produce an output time-delayed signal corresponding to the input microwave RF signal shifted in phase by the corresponding time delay, whereby the plurality of output time-delay signals are radiated through antenna elements to form a desired beam pattern.

The second time-delay circuit also includes on each MMIC a digital phase shifter for shifting the phase of the incident microwave RF signal by a predetermined amount. Therefore, the integrated circuit chip (MMIC) has both time-delay means and digital phase shift means and is operable in a first mode to time-delay the input RF microwave signal in response to control signals to cause a corresponding shift in phase of the signal at an output of the circuit, and operable in a second mode to time-delay and phase delay the input RF microwave signal in response to control signals to cause a shift in phase of the signal at the output of the circuit corresponding to the sum of the phase shifts caused by each of the individual time-delays and digital phase delay.

BRIEF DESCRIPTION OF THE DRAWINGS

The invention is to be explained in more detail below based on embodiments, depicted in the following figures where.

DETAILED DESCRIPTION OF THE INVENTION

Figure 1:
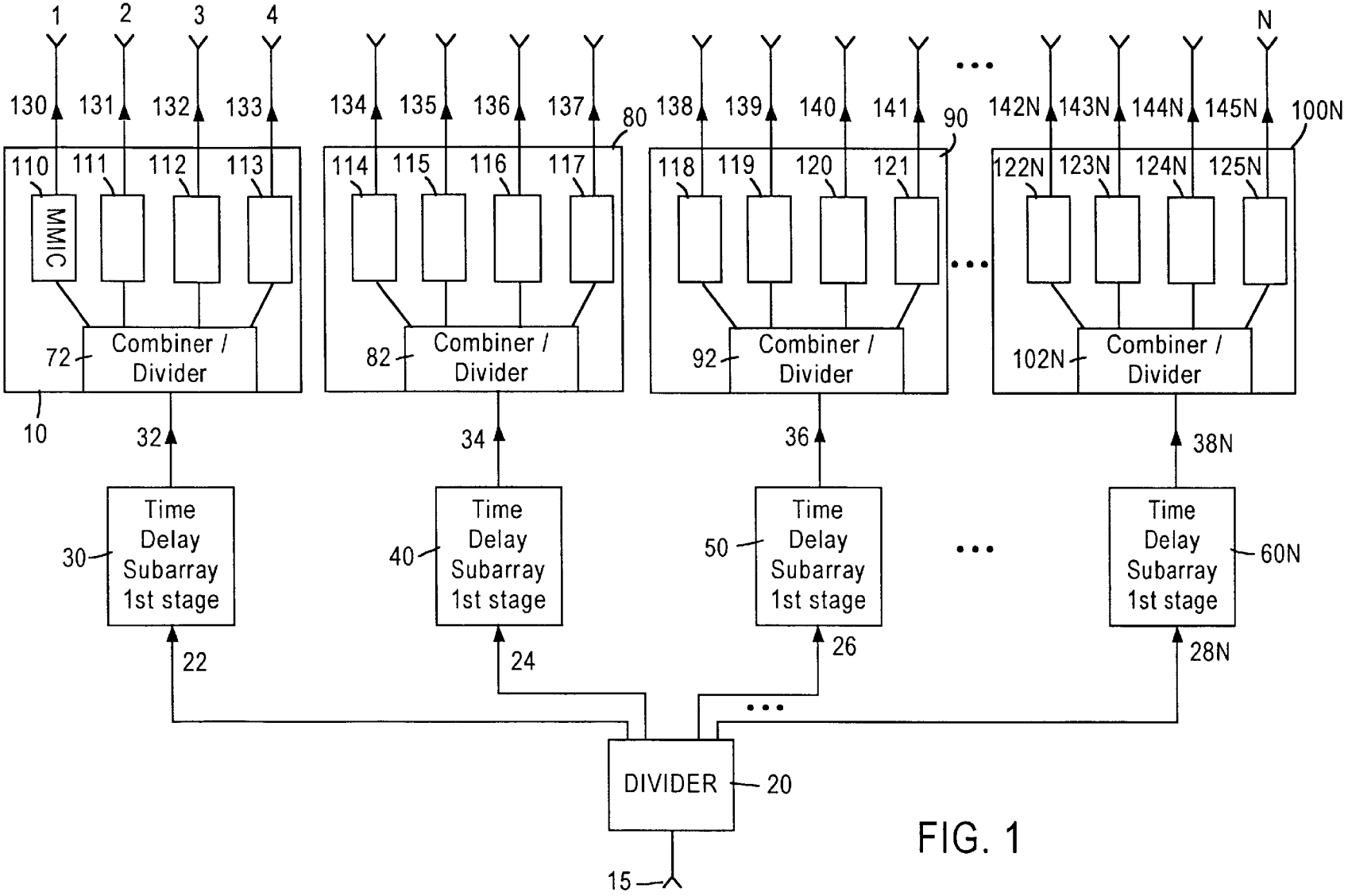
FIG. 1 is an exemplary embodiment of the phased array system employing time-delay microwave signal processing of the present invention.
Figure 1A:
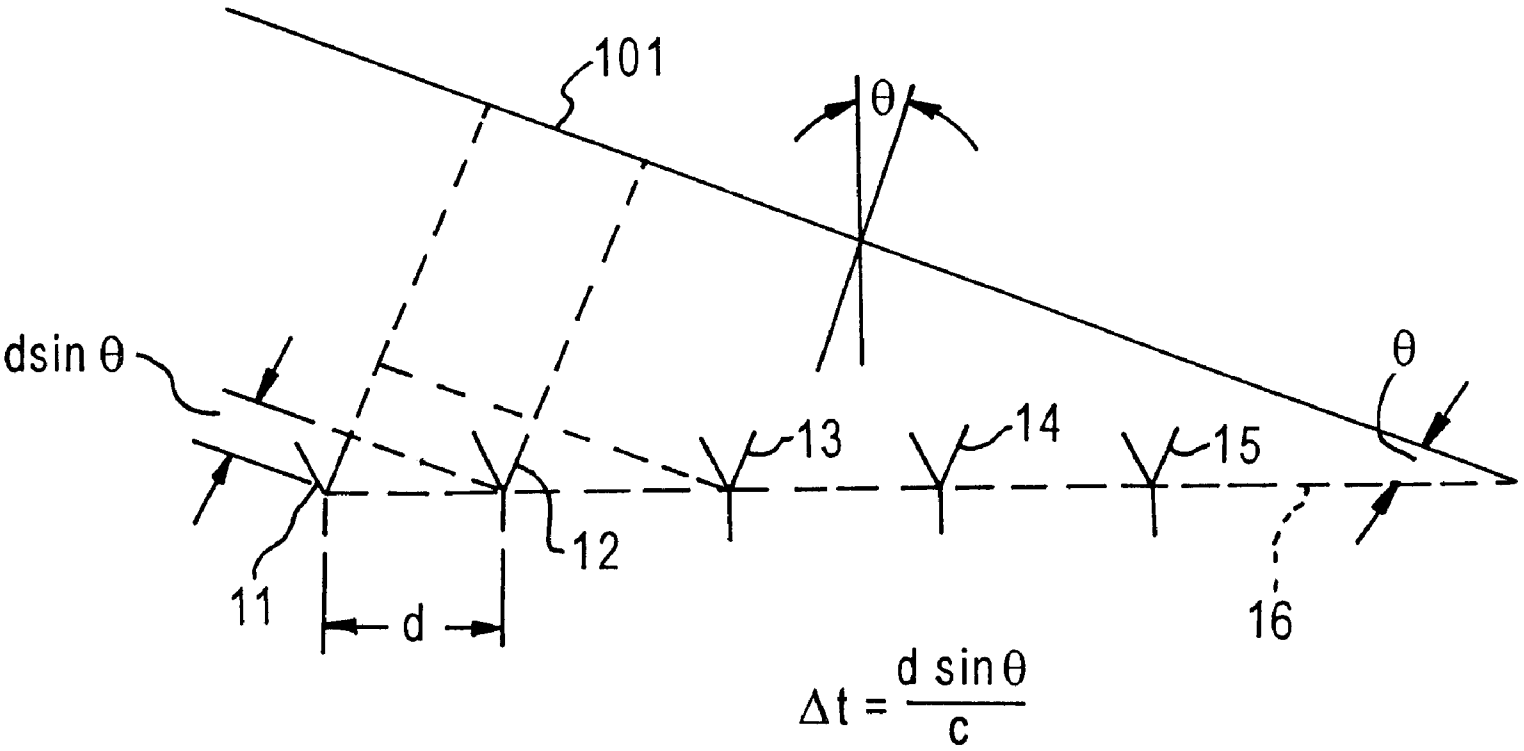
FIG. 1A schematically illustrates a steered phased array antenna.

In FIG. 1A, a plane wavefront is illustrated by a line 101 moving at an angle $\Theta$ between the wavefront and a linear array of equally spaced antenna elements 11, 12, 13, 14, and 15 or more on dotted line 16. Note that wavefront 101 reaches antenna element 11 a time $\Delta t$ later than it reaches antenna element 12 where $\Delta t = d\sin(\Theta)/c$ where c is the velocity of propagation and d is the antenna element spacing.

All this is well known in the prior art. The direction of propagation of the plane wavefront 101 in FIG. 1A is then normal to wavefront line 101. The magnitude of $\Delta t$ is then a sine function of the magnitude of $\Theta$. Thus, if all the antenna elements 11–15 are equally spaced, wavefront 101 reaches antenna element 11 at a time period $\Delta t$ after it reaches antenna element 12, a time period of $2\Delta t$ after it reaches antenna element 13, a time period $3\Delta t$ after it reaches antenna element 14 and a time period of $4\Delta t$ after it reaches antenna element 15.

The basic concept relevant to this invention is that by switching a microwave signal into either of two transmission lines each having a different physical length, a differential time delay of a signal traversing the second path length $L_2$ relative to the same signal traversing the first path length $L_1$ (i.e. reference signal) can be generated. In this manner, the signals at each of the antenna elements can be delayed by the appropriate amount relative to one another to compensate for the initial phase difference of the incident common wavefront at each element to permit proper antenna scanning and beamforming. The differential path length $\Delta L$ is equal to $$\Delta L = L_2 - L_1$$

and the differential time delay $\Delta t$ is equal to $$\Delta t = \Delta L / v$$

where v=the velocity of propagation of the transmission line. In order to provide variable set of time shifts, a set of time delay circuits can be connected in series with the delays arranged in a binary sequence, e.g. delay values in the ratio of 1,2,4, . . . $2^n$. In this manner, a circuit having a power divider and a switch for selecting the appropriate transmission path length according to a single control bit can be generated to delay the input signal by a predetermined amount. By providing a true time-delayed signal, the RF phase shift is linearly proportional to the RF frequency, thereby providing accurate beam steering and beam focusing for phased array antenna systems.

In FIG. 1, identified by the general reference character 10, an RF microwave input signal 15 is input into a conventional power divider 20 to energize N first stage time delay subarrays 30, 40, 50, . . . 60N to delay each of the RF input signals 22, 24, 26, 28N by a controlled amount to perform coarse beamforming during transmit mode. The time-delayed output signals 32, 34, 36, 38N from each of the respective time delay subarrays are then input into a corresponding second delay stage module (reference numerals 70, 80, 90, . . . 100N). Each second delay stage module (e.g 70, 80, 90, or 100N) preferably comprises a conventional signal divider/combiner 72, 82, 92, or 102N for dividing the time-delayed signal received from the first stage subarray (e.g. 30, 40, 50, or 60) and four gallium arsenide-based monolithic microwave integrated circuit (MMIC) chips 110–113 coupled to the respective outputs of each signal divider/combiner (e.g. 72, 82, 92, or 102N) to perform more precise beam steering and focusing by further phase shifting the corresponding RF signal (32) by time-delaying the signal in a controlled fashion and by a predetermined amount. The output of each MMIC chip associated with the corresponding module 110, 111, 112, 113, 114, 115, 116, 117, 118, 119, 120, 121, 122N, 123N, 124N, 125N, 70, 80, 90, . . . 100N is coupled to an antenna array element N for radiating the corresponding time-delayed output signal 130, 131, 132, 133, 142, 143, 144, 145N to form a beam pattern according to a predetermined direction.

Figure 2:
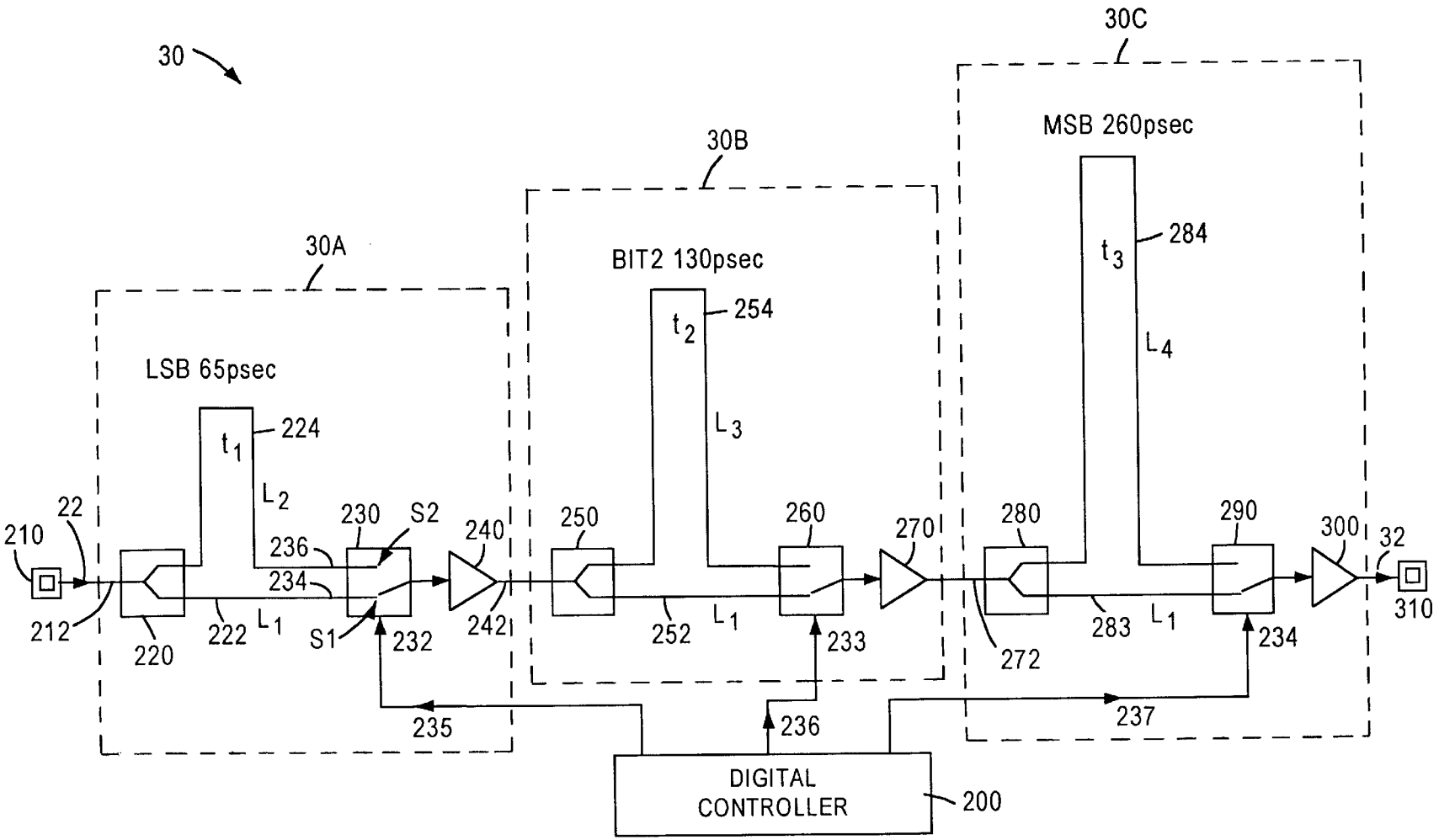
FIG. 2 is an exemplary diagram illustrating a 3 bit controllable time-delay circuit of the present invention.
Figure 2A:
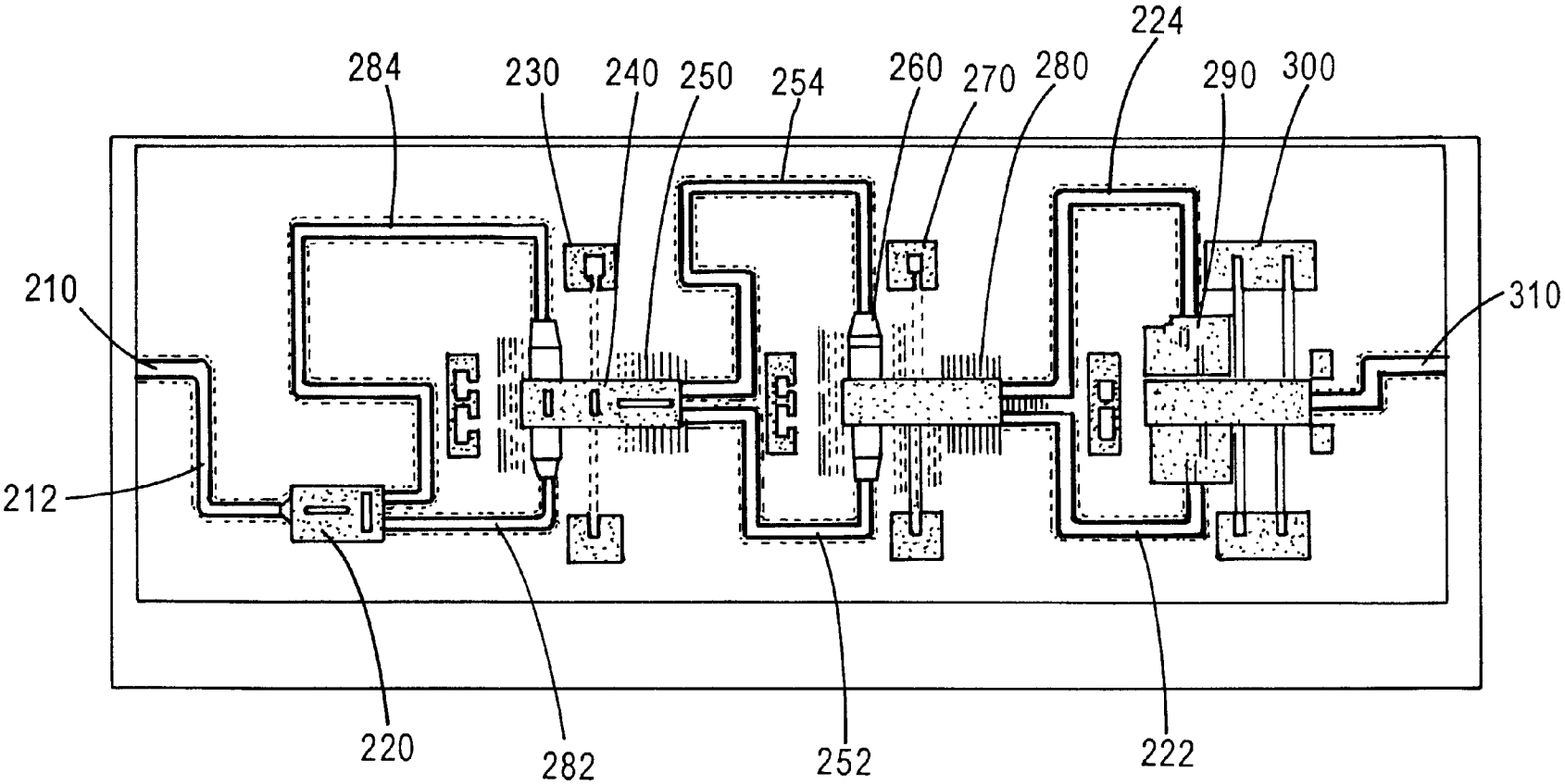
FIG. 2A is a top view diagram of a 3 bit controllable time-delay GaAs based MMIC of the present invention.

Referring now to FIG. 2, there is shown a detailed view of an embodiment of a first time delay subarray microwave circuit 30 of FIG. 1. In the embodiment depicted in FIG. 1, all first time-delay subarray circuits are identical in structure and function. Therefore, an in-depth description of one circuit serves to describe the functionality of all first time-delay microwave circuits. In referring to this figure and all figures herein, like reference numerals are used to describe like elements and which may not be described in detail for all figures. Referring again to FIG. 2, a 3-bit controlled first time-delay microwave circuit 30 comprising subcircuits 30A, 30B, and 30C is shown for time-delaying RF microwave signals. FIG. 2A illustrates a top view layout of such a circuit implemented with discrete GaAs-based MMIC chips interconnected on a multilayer substrate fabricated by processes well known in the art. A digital controller 200 selectively controls the amount of time-delay introduced by the circuit on the incident microwave RF signal 22 as it propagates through the circuit. The first time-delay circuit 30A includes an input port 210 for receiving the input signal 22 into the circuit. A conventional divider 220 coupled to port 210 splits the input RF signal 22 into a first conductive line segment 222 of length LI and a second conductive line segment 224 of length L2, where L2>L1. A single pole double throw switching means 230 is electronically coupled at terminals 234 and 236 to each of the conductive line segments at an end opposite divider 220 to switchably connect one of the two path lengths (i.e. L1 or L2) to conduct the RF signal 22. Switch 230 is controlled by digital controller 200 and accepts a signal 235 at input port 232 indicating which terminal should be connected to conductively propagate the RF signal (i.e. L1 or L2). In the preferred embodiment, a binary signal (e.g. 0) from digital controller 200 to switch 230 causes switch 230 to be placed in position SI so that the input microwave signal 22 is conducted along line length L1 (i.e. reference length). A binary signal of opposite polarity (e.g. 1) from digital controller 200 to switch 230 causes switch 230 to be placed in position S2 so that the input microwave signal 22 is conducted along line length L2, resulting in a time delay of the signal relative to L1. In this manner, the RF signal output from switch 230 may be time-delayed by an amount proportional to the transmission line length L2 relative to L1 to produce a phase-shifted signal 24. The amount of phase shift is therefore proportional to the relative line lengths. RF amplifier 240 is coupled to the output of switch 230 for amplifying the RF signal by an appropriate amount to compensate for insertion loss due to switch 230 and an approximate 3 dB loss resulting from divider 220. In order to provide a variable set of time-delays corresponding to RF signal phase shifts, sets of time-delay circuits having differing line segment lengths are serially connected as shown in FIG. 2 (i.e. reference numerals 30A, 30B, 30C) with delays arranged in binary sequence such that delay values have the ratio of 1, 2, 4, . . . , $2^n$. In like manner, circuit 30B has divider 250 coupled to amplifier output 240 for directing the signal output from circuit 30A into conductive line segment 252 of length L1 and conductive line segment 254 of length L3, where L3>L2>L1. Similarly, circuit 30C includes divider 280 coupled to amplifier output 270 for directing the signal output from circuit 30B into conductive line segment 282 of length L1 and conductive line segment 284 of length L4, where L4>L3>L2>L1.

As shown in FIG. 2, digital controller 200 is operable to selectively control each of switches 230, 260 and 290 by control signals 235, 236, 237 respectively input at each of their respective ports 232, 233 and 234 to enable selective switching of the propagation paths of the input RF microwave signal 22 through each of the subcircuits 30A, 30B, 30C. This controlled switching causes the resultant signal 32 output from circuit 30 at port 310 to be delayed by an amount equal to the sum of each of the time delays t1, t2, t3 caused by propagation through each of the respective subcircuit path lengths. The circuit shown in FIG. 2 may therefore be implemented using a 3-bit digital controller wherein the value (i.e. 0 or 1) of the least significant bit (LSB) serves to selectively switch the propagation path (L1 or L2) of subcircuit A, the second bit serves to selectively switch the propagation path (L1 or L3) of subcircuit B, and the most significant bit (MSB) selectively switches the propagation path (L1 or L4) of subcircuit C. For example, if L2 introduces a delay of 65 picoseconds (psec), L3 delays the signal by 130 psec, and L4 causes a delay of 260 psec, then a bit sequence of 001 (MSB BIT2 and LSB) from digital controller 200 would cause a delay of 65 psec in the output signal 32, while a bit sequence of 111 would cause a 455 psec delay in the output signal. Thus the circuit illustrated in FIG. 2 provides true time delays of 0 to 455 psec in 65 psec increments for phase shifting an incoming microwave RF signal, without requiring additional modulation techniques or extensive amplification means. As is well known, the phase of a signal may be determined by $\ominus=(360°)\cdot(\Delta t\cdot f)$ where $\Delta t$ is the time delay and f is the frequency. Therefore, for a frequency of 6 GHz and a time delay of 65 psec, the relative phase of the signal is approximately 140.4°. As is well known, conventional phase steered arrays require total phase shifts of 360 degrees. In this manner, the relative insertion phase of a signal may be controlled by selectively controlling the time delays given by the various propagation paths through the GaAs microwave circuit. Furthermore, the use of GaAs-based circuits allows for switching times to be less than 1 microsecond (1 usec), thereby permitting increased switching speed so as to more quickly direct and focus an array.

Figure 2B:
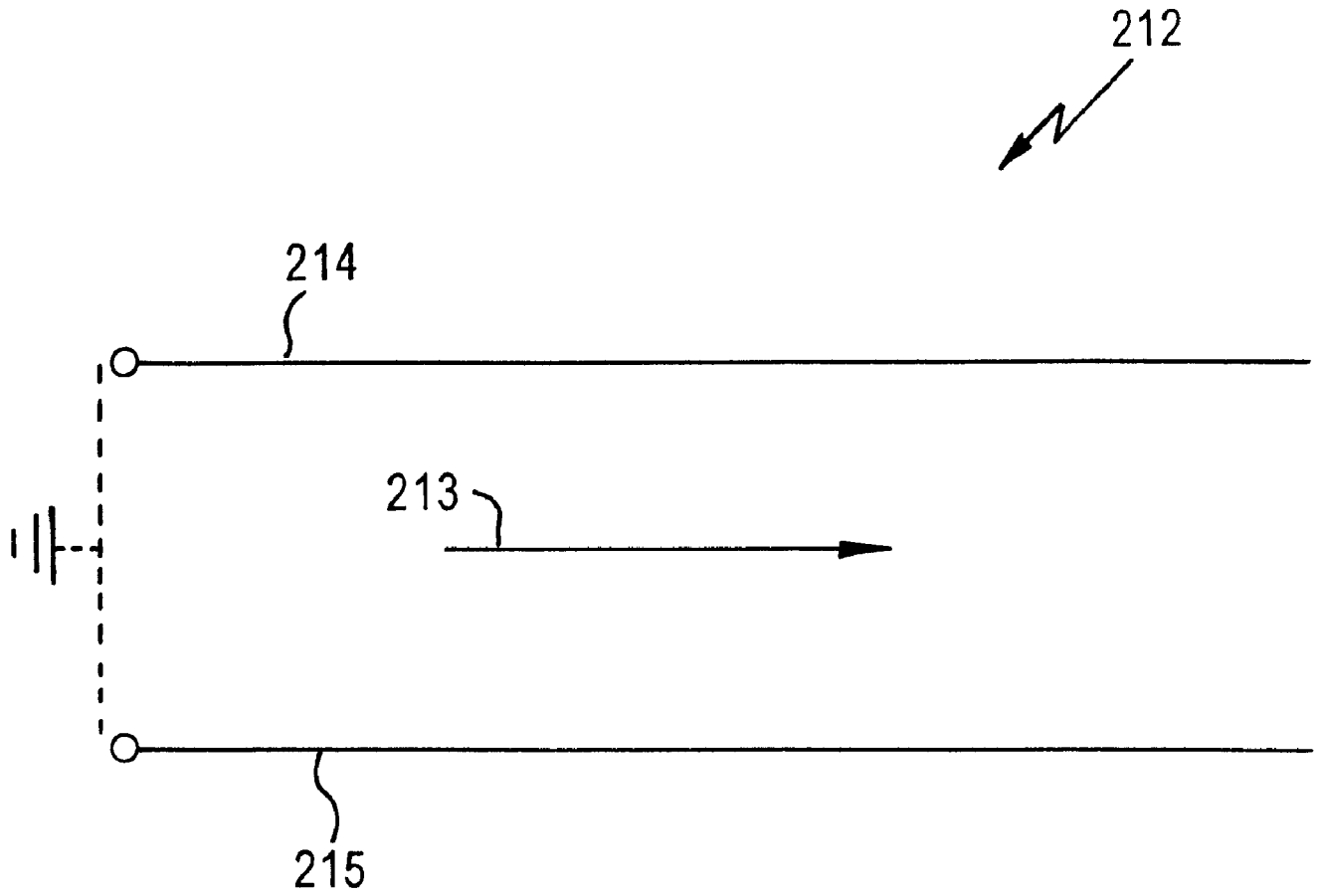
FIG. 2B PRIOR ART
FIG. 2B is an exemplary diagram of a stripline conductor.
Figure 3:
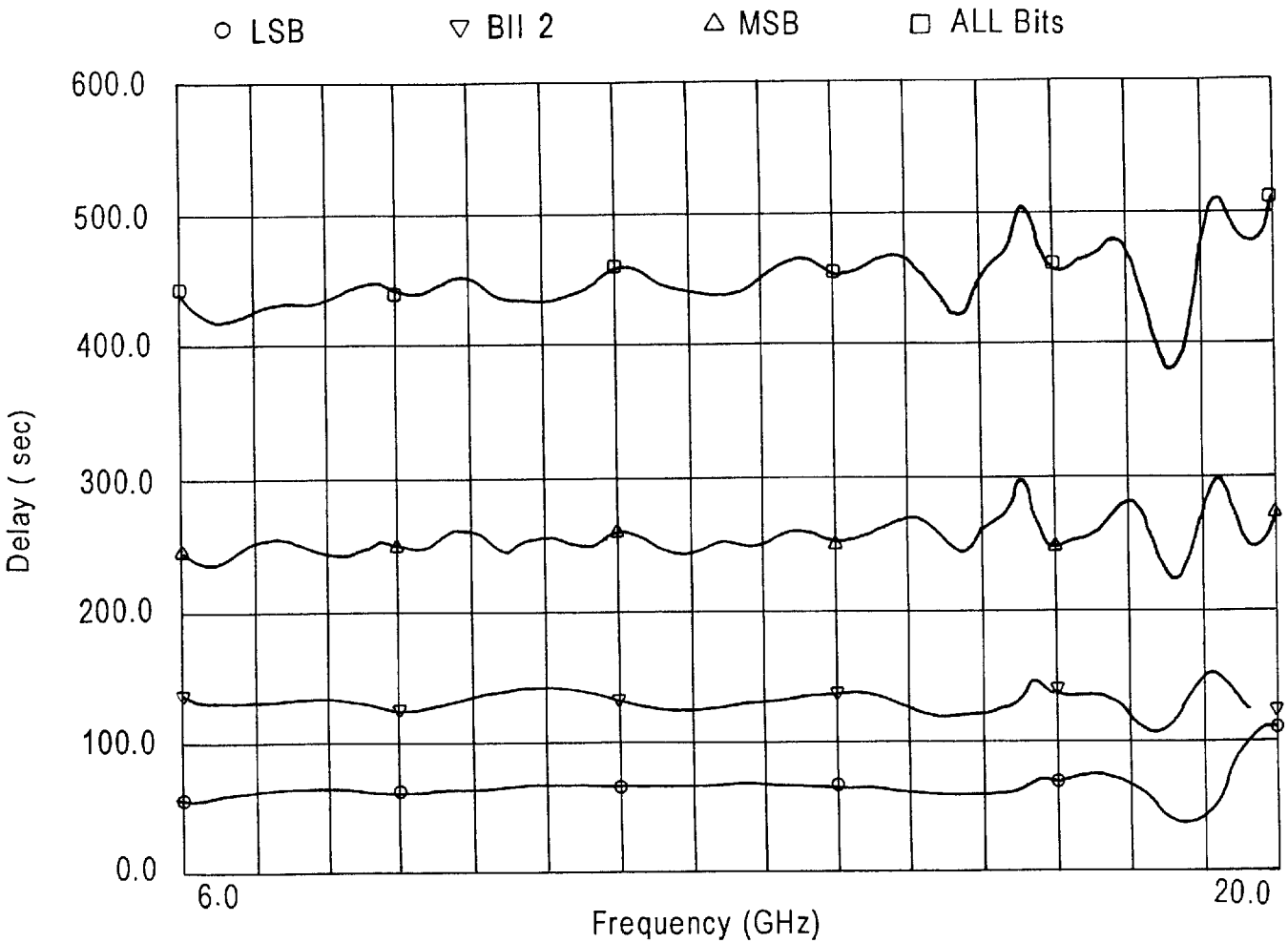
FIG. 3 is a diagram illustrating the performance of the controllable time-delay circuit of FIG. 2.

As previously stated, in the preferred embodiment, the time delay circuit 30 is comprised of subcircuits 30A, 30B, and 30C and implemented with discrete GaAs-based MMIC chips for each subcircuit interconnected on a multilayer substrate by means of striplines 212, 242, and 272. As is well known in the art, the stripline is a pure TEM mode of propagation, thus providing a time delay which is constant with frequency. A conventional stripline 212 is shown in FIG. 2B, having a conductive TEM transmission line 213 disposed between dual conductive ground planes 214 and 215. Performance of the time delay circuit 30 is shown in FIG. 3. The curves indicate that the time delay is essentially constant over the operating bandwidth of 6 GHz to 18 GHz. The small variations are caused by multiple reflections in the circuit introduced by impedance mismatches at the ends of the transmission lines. These variations may be minimized by designing the subcircuits to be well matched over the operating bandwidth.

Figure 4B:
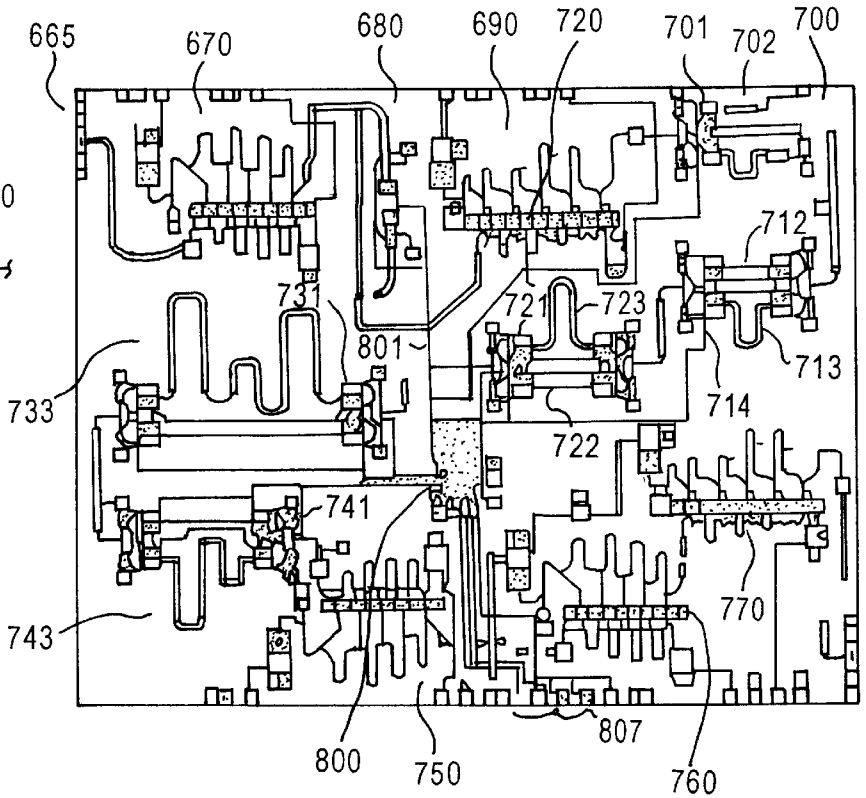
FIG. 4B is a top view diagram of a 6 bit controllable time-delay and phase delay MMIC of the present invention.
Figure 4A:
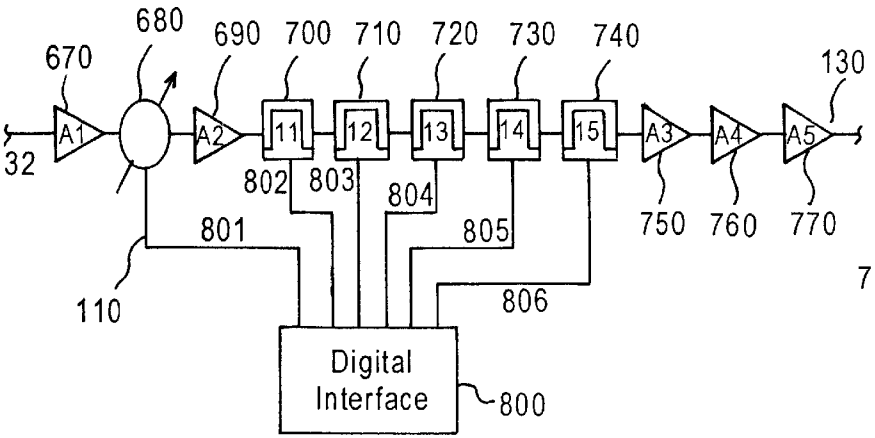
FIG. 4A is a schematic diagram of a 6 bit controllable time-delay and phase delay circuit of the present invention.

For relatively small time delays of approximately 1 to 100 picoseconds (psec), time delay circuits can be implemented entirely on a single integrated circuit in the form of an MMIC as shown in FIG. 4B. Referring to FIGS. 4A and 4B in conjunction with FIG. 1,these figures illustrate a detailed view of the second time-delay stage portion of module 70 of FIG. 1. FIG. 4A represents a schematic view of GaAs MMIC time delay module 110 while FIG. 4B illustrates a top view layout of the GaAs-based MMIC chip. As seen in FIG. 4A, MMIC 110 comprises five individual time delay circuits 700, 710, 720, 730, 740 serially coupled and having corresponding time-delay values of 3, 6, 12, 24, and 48 psec, respectively. MMIC chip 110 also includes a digital interface 800 which accepts input signals from a digital controller (not shown) directing the activation/deactivation of each of the particular time delays 700–740 in an instantaneous bandwidth mode.

Referring now to FIG. 4B in conjunction with 4A, input port 665 accepts RF microwave signal 32 for processing. Amplifier 670 adjusts the magnitude of the signal 32 for input to digital phase shifter 680 which accepts a control signal 801 from digital interface module 800 coupled to the digital controller (not shown) through conductive terminals 807 to phase shift the input signal by either 0 or 180 degrees (i.e. "on" or "off"). In situations requiring instantaneous bandwidth, control signal 801 indicative of the "off" condition is applied so that no phase shift occurs by way of module 680. First time delay module 700 is coupled to module 680 by isolation amplifier 690 to electrically decouple the signal and adjust the magnitude and comprises a switch 701 conductively coupled in a first position to transmission line 702 of length L1 (reference) and in a second position to transmission line 703 of length L2. Responsive to control signal 802 from module 800, switch 701 conductively engages one of the transmission line segments (702 or 703) to permit signal 32 to propagate along the selected path. Because line segment 703 is longer than line 702, propagation over line 703 introduces a time delay in the signal relative to line 702, causing a corresponding phase shift in signal 32. In the preferred embodiment, line segment 703 introduces a 3 picosecond (3 psec) delay. In similar manner, second time-delay module 710 comprising switch 711 and line segments 712 (reference) and 713 (L3) is serially coupled to the output of module 700 for further selectively delaying signal 32 in accordance with control signal 803 input at switch 711. Line segment L3 has a correspondingly longer path segment than L2, thereby causing additional delay in signal transmission. In the preferred embodiment, line segment 713 introduces a 6 picosecond (6 psec) delay. Third time-delay module 720 may introduce a 12 psec delay in signal transmission when line segment 723 (L4) is switchably connected to the output of module 710 in response to control signal 804 at switch 721. In like manner, fourth and fifth time-delay modules 730 and 740 may introduce additional 24 psec and 48 psec delays in signal transmission relative to their reference lengths when corresponding line segments 733 and 743 (L5 and L6) are switchably connected in response to control signals 805 and 806. MMIC chip 110 further includes amplifiers 750 and 760 and isolation amplifier 770 serially coupled to one another with amplifier 750 coupled to the output of module 740 to further amplify and condition the resulting output time-delayed (and hence phase-shifted) signal 130. In the preferred embodiment, amplifiers 670, 750 and 760 have values of 16 dBm, while isolation amplifiers 690 and 770 have values of 2 dBm.

As one can ascertain, the MMIC chip 110 shown in FIGS. 4A, 4B can thus provide a total delay of up to 93 psec in 3 psec increments. This corresponds to a total phase shift of $\ominus=(360°)\cdot(\Delta t\cdot f)$ of approximately 201° for a frequency of 6 GHz in increments as low as 6.5° (corresponding to 3 psec); and a phase shift $\ominus$ of approximately 603° for a frequency of 18 GHz in increments as small as 19.5°. The total delay of 93 psec included in module 110 is generally sufficient for small arrays of 16 elements (4×4) to provide instantaneous bandwidths of 6–18 GHz and may be implemented as such. For larger arrays requiring instantaneous bandwidths of 6–18 GHz, the configuration of FIG. 1 can be used wherein the MMIC chips 110 in combination with time shifter circuits 30 (FIG.2) provides instantaneous bandwidths and variable phase shifts.

Alternatively, the MMIC chip 110 also is operable in a non-instantaneous bandwidth mode to provide approximately 381° of phase shift for steering a phased array. As previously stated, the total phase shift required for a conventional phase steered array is 360°. The MMIC chip 110 in this embodiment further activates (i.e. turns "on") the 180° digital phase shifter 680 serially coupled to time-delay module 700 by isolation amplifier 690. Amplifier 670 couples the RF signal microwave signal 32 input to MMIC chip 110 to phase shifter 680. Digital phase shifter 680 is coupled to digital interface module 800 to receive a control bit indicating a phase shift of either 0° (i.e. no shift) or 180°. For non-instantaneous bandwidth situations, the control signal bit 801 applied to module 690 indicates activation of the digital phase shifter, thereby providing 180 degrees of phase shift. In this manner, a digital controller (not shown) controls the relative phase and time-delays throughout the MMIC 110 by including a phase bit transmitted over line 801 by module 800 in addition to the five time-delay bits transmitted over lines 802–806 corresponding to each of the respective time-delays. As previously shown, each of the time-delay modules and phase shifter are responsive to the digital controller to switch conductive path lengths according to the bit values received. In this manner, the MMIC chip 110 provides this capability over the full operating bandwidth of 6 to 18 GHz as follows:

Time Delay: 0 to 93 psec; Least significant BIT (LSB)=3 psec

Phase Shift:

at 6 GHz 0 to 381°; LSB=6° at 18 GHZ 0 to 782°; LSB=19°.

As can be ascertained, the MMIC time and phase delay chip 110 can be used in a large array without requiring additional time shifters to provide between 381° and 782° of phase shift over a 6–18 GHz non-instantaneous bandwidth in cases where a large instantaneous bandwidth is not required.

It should be understood that the line lengths for time-delaying the propagation of RF microwave signals are dependent on the dielectric constant or permittivity of the material in which the signal propagates. For a typical dielectric constant of k=10, the required line length is 1/sqrt(10) or approximately ⅓ that of free space.

While there has been shown preferred embodiments of the present invention, those skilled in the art will further appreciate that the present invention may be embodied in other specific forms without departing from the spirit or central attributes thereof. All such variations and modifications are intended to be within the scope of this invention as defined by the appended claims.

What is claimed is:

1. A antenna array, comprising a plurality of elements coupled to respective antennae, for radiating respective time delayed microwave signals having a wide instantaneous bandwidth ranging between 6 and 18 GigaHertz (GHz), each of the elements comprising:

a respective digital phase shifter responsive to a first control signal for imparting one of a 0° degree and a 180° degree phase shift to an input microwave signal applied thereto; and a respective time-delay module coupled to an output of the corresponding digital phase shifter and responsive to a second control signal for imparting one of a plurality of time delays to the microwave signal;

wherein the plurality of time delays are substantially constant over said bandwidth.

2. The antenna array of claim 1, wherein the respective time delay module comprises:

a respective first transmission line for imparting a corresponding first time delay to the electromagnetic signal;

a respective second transmission line for imparting a corresponding second time delay to the electromagnetic signal, said respective second time delay being longer than the corresponding first time delay;

a respective splitter coupled to the corresponding first transmission line and the corresponding second transmission line for dividing the electromagnetic signal into the respective first transmission line and the respective second transmission line; and a respective switch for selectively connecting one of the corresponding first transmission line and the corresponding second transmission line to [an] a respective output in response to the second control signal.

3. The antenna array of claim 1, wherein:

the respective time delay module is disposed on a monolithic microwave integrated circuit (MMIC) having dual conductive ground planes;

the respective first transmission line comprises a first stripline conductor disposed between the dual conductive ground planes; and the respective second transmission line comprises a second stripline conductor disposed between the dual conductive ground planes.

4. A time-delay circuit for imparting a selected time delay to a microwave signal, comprising:

a first transmission line for imparting a first time delay to the microwave signal;

a second transmission line for imparting a second time delay to the microwave signal, said second time delay being longer than the first time delay;

a splitter coupled to the first transmission line and the second transmission line for dividing the microwave signal into the first transmission line and the second transmission line; and a single-pole double-throw switch for selectively connecting one of the first transmission line and the second transmission line to an output in response to a control signal.

5. The time-delay circuit of claim 4, wherein the time-delay circuit is comprised of a gallium-arsenide-based monolithic microwave integrated circuit chip.

6. The time-delay circuit of claim 4, further comprising a controller coupled to the switch for providing the control signal.

7. The time-delay circuit of claim 4, wherein:

the first transmission line includes a first stripline having a first length for imparting said first time delay; and the second transmission line includes a second stripline having a second length, greater than the first length, for imparting said second time delay.

8. The time-delay circuit of claim 4, further comprising an amplifier coupled to the output of the switch for adjusting a magnitude of the microwave signal in compensation of losses during transmission.

9. A method of imparting a selected time delay to an electromagnetic signal having a frequency within a bandwidth ranging between 6 and 18 GigaHertz (GHz), comprising:

dividing the electromagnetic signal into a first split electromagnetic signal and a second split electromagnetic signal;

imparting a first time delay and a first phase shift to the first split electromagnetic signal, said first phase shift being linearly proportional to the frequency, and said first time delay being substantially constant over said bandwidth;

imparting a second time delay and a second phase shift to the second split electromagnetic signal, said second time delay being longer than the first time delay and said second phase shift being linearly proportional to the frequency and said second time delay being substantially constant over said bandwidth; and selectively outputting one of the delayed first split electromagnetic signal and the delayed second split electromagnetic signal in response to a control signal.

10. A time-delay circuit for imparting a selected time delay to an electromagnetic signal, comprising a plurality of time delay modules coupled in series for selectively imparting respective differential time delays to the electromagnetic signal, each of said time delay modules including:

a respective pair of transmission lines of different lengths;

a respective splitter coupled to each of the corresponding pair of transmission lines for dividing the signal into each of the corresponding pair of transmission lines; and a respective switch for selectively connecting one of the corresponding pair of transmission lines to a respective output in response to a corresponding control signal; and wherein a difference of the different lengths of one of the pair of transmission lines is twice a difference of the different lengths of another one of the pair of transmission lines.

11. A gallium-arsenide-based monolithic microwave integrated circuit chip comprising a time-delay circuit for imparting a selected time delay to a microwave signal having a bandwidth ranging between 6 and 18 GigaHertz (GHz), said time-delay circuit comprising:

a first stripline having a first length for imparting a first time delay to the microwave signal;

a second stripline having a second length, greater than the first length, for imparting a second time delay to the microwave signal, said second time delay being greater than said first time delay;

a splitter coupled to the first stripline and the second stripline for dividing the microwave signal into the first stripline and the second stripline; and a single-pole, double-throw switch for selectively connecting one of the first stripline and the second stripline to an output in response to a control signal;

an amplifier coupled to the output of the single-pole, double-throw switch for adjusting a magnitude of the microwave signal in compensation of losses during transmission; and a controller coupled to the single-pole, double-throw switch for providing the control signal;

wherein said selected time delay is substantially constant over said bandwidth.

* * * * *